US012613068B2

(12) United States Patent
Chen et al.

(10) Patent No.: US 12,613,068 B2
(45) Date of Patent: Apr. 28, 2026

(54) HEAT EXCHANGER

(71) Applicant: Danfoss A/S, Nordborg (DK)

(72) Inventors: Lisha Chen, Nordborg (DK); Weijun Wu, Nordborg (DK); Yubao Liu, Nordborg (DK); Yanxing Li, Nordborg (DK)

(73) Assignee: DANFOSS A/S, Nordborg (DK)

( * ) Notice: Subject to any disclaimer, the term of this patent is extended or adjusted under 35 U.S.C. 154(b) by 330 days.

(21) Appl. No.: 18/299,322

(22) Filed: Apr. 12, 2023

(65) Prior Publication Data

US 2023/0375289 A1 Nov. 23, 2023

(30) Foreign Application Priority Data

May 17, 2022 (CN) ..... 202221200233.2

(51) Int. Cl.
*F28F 9/02* (2006.01)
*F28D 1/053* (2006.01)
*F28D 21/00* (2006.01)

(52) U.S. Cl.
CPC ..... *F28F 9/027* (2013.01); *F28D 1/05316* (2013.01); *F28D 21/00* (2013.01); *F28D 2021/0068* (2013.01)

(58) Field of Classification Search
CPC ..... F28F 9/0256; F28F 9/0248; F28F 9/0246; F28F 9/0275; F28F 9/0273; F28F 9/027; F28F 9/026
See application file for complete search history.

(56) References Cited

U.S. PATENT DOCUMENTS 1,684,083 A * 9/1928 Bloom ..... F28F 9/0273 165/174
2005/0275219 A1* 12/2005 Hiyama ..... F28F 9/0256 285/205
2006/0070399 A1* 4/2006 Bae ..... F28D 1/05383 62/504
2008/0023183 A1 1/2008 Beamer et al.
2008/0023184 A1* 1/2008 Beamer ..... F28F 9/0273 165/174

(Continued)

FOREIGN PATENT DOCUMENTS

EP 3021064 A1 5/2016
GB 608972 A 9/1948

OTHER PUBLICATIONS

Extended European Search Report corresponding to European Patent Application No. 23165802.2 dated Sep. 22, 2023.

*Primary Examiner* — Frantz F Jules
*Assistant Examiner* — Jason N Thompson
(74) *Attorney, Agent, or Firm* — McCormick, Paulding & Huber PLLC

(57) ABSTRACT

A heat exchanger includes: a manifold having a manifold opening passing through a pipe wall of the manifold; a distribution pipe disposed in the manifold and having a distribution pipe opening passing through a pipe wall of the distribution pipe; and a connecting pipe assembly including a first connecting pipe The first connecting pipe is inserted in the manifold opening, has an end connected to the distribution pipe at the distribution pipe opening, and is in fluid communication with the distribution pipe. Thereby, the space occupied by the connecting pipe assembly in the manifold can be reduced.

19 Claims, 5 Drawing Sheets

(56) References Cited

U.S. PATENT DOCUMENTS

| | | | | |
|---|---|---|---|---|
| 2010/0300667 | A1* | 12/2010 | Samuelson | F28F 9/0273 165/181 |
| 2016/0216014 | A1* | 7/2016 | Morimoto | F28F 1/022 |
| 2020/0191489 | A1* | 6/2020 | Kim | F28D 1/05325 |
| 2021/0131736 | A1 | 5/2021 | Joardar et al. | |

* cited by examiner

HEAT EXCHANGER

CROSS-REFERENCE TO RELATED APPLICATION

This application claims foreign priority benefits under 35 U.S.C. § 119 from Chinese Patent Application No. 202221200233.2, filed May 17, 2022, the content of which is hereby incorporated by reference in its entirety.

TECHNICAL FIELD

The present disclosure relates to a heat exchanger.

BACKGROUND

The heat exchanger includes a connecting pipe assembly for connecting a pipeline of a refrigeration system to a distribution pipe located in a manifold. The connecting pipe assembly usually takes up a large space in the manifold.

SUMMARY

It is an object of the present disclosure to provide a heat exchanger, thereby, for example, reducing the space occupied by the connecting pipe assembly in the manifold.

Embodiments of the present disclosure provide a heat exchanger, including: a manifold having a manifold opening passing through a pipe wall of the manifold; a distribution pipe disposed in the manifold and having a distribution pipe opening passing through a pipe wall of the distribution pipe; and a connecting pipe assembly including a first connecting pipe, wherein the first connecting pipe is inserted in the manifold opening, has an end connected to the distribution pipe at the distribution pipe opening, and is in fluid communication with the distribution pipe.

According to embodiments of the present disclosure, the first connecting pipe includes a flange extended towards a radial outside from the end of the first connecting pipe, wherein the flange is connected to a portion of the pipe wall of the distribution pipe surrounding the distribution pipe opening.

According to embodiments of the present disclosure, an inner diameter of the end of the first connecting pipe is smaller than an inner diameter of the distribution pipe opening; and the connecting pipe assembly further includes an insertion pipe, wherein a first end of the insertion pipe close to the first connecting pipe is inserted in the distribution pipe opening, and an end face of the first end of the insertion pipe abuts against an end face of the end of the first connecting pipe, and a second end of the insertion pipe opposite to the first end is located in the distribution pipe.

According to embodiments of the present disclosure, the distribution pipe includes: a first distribution pipe section and a second distribution pipe section spaced apart from each other in an axial direction and a distribution pipe connecting section connected between the first distribution pipe section and the second distribution pipe section, and the distribution pipe opening is formed in the distribution pipe connecting section.

According to embodiments of the present disclosure, the distribution pipe connecting section of the distribution pipe and the first connecting pipe of the connecting pipe assembly are an integrated three-way pipe.

According to embodiments of the present disclosure, the connecting pipe assembly further includes a second connecting pipe, and an end face of an end of the second connecting pipe close to the manifold is connected to a portion of the pipe wall of the manifold surrounding the manifold opening.

According to embodiments of the present disclosure, the second connecting pipe of the connecting pipe assembly includes a flange extended towards a radial outside from the end of the second connecting pipe close to the manifold.

According to embodiments of the present disclosure, the second connecting pipe of the connecting pipe assembly further includes a protrusion or annular step protruding towards a radial inside from an inner wall of the second connecting pipe on a side of the second connecting pipe close to the manifold.

According to embodiments of the present disclosure, an inner diameter of the end, close to the manifold, of the second connecting pipe of the connecting pipe assembly is greater than an inner diameter of the manifold opening.

According to embodiments of the present disclosure, the end of the first connecting pipe is inserted in the distribution pipe opening.

According to embodiments of the present disclosure, the first connecting pipe further includes an annular step portion located on an outer wall of the first connecting pipe and adjacent to the end of the first connecting pipe, and a portion of the pipe wall of the distribution pipe surrounding the distribution pipe opening abuts against the annular step portion of the outer wall of the first connecting pipe.

According to embodiments of the present disclosure, the first connecting pipe further includes an annular step portion located on an inner wall of the first connecting pipe and adjacent to the end of the first connecting pipe.

According to embodiments of the present disclosure, the manifold further has a heat exchange tube connecting opening passing through the pipe wall of the manifold, the heat exchanger further includes a heat exchange tube having an end connected to the heat exchange tube connecting opening of the manifold, and an angular interval between a centerline of the manifold opening and a centerline of the heat exchange tube connecting opening in a circumferential direction of the manifold is between 60° and 180°.

According to embodiments of the present disclosure, the first connecting pipe is extended to an outside of the manifold through the manifold opening of the pipe wall of the manifold.

According to embodiments of the present disclosure, the connecting pipe assembly is disposed at a position between a first point and a second point in an axial direction of the manifold, a distance from the first point to one end, in the axial direction, of the manifold in the axial direction of the manifold is ¼ of a total length of the manifold, and a distance from the second point to the one end, in the axial direction, of the manifold in the axial direction of the manifold is ¾ of the total length of the manifold.

With the heat exchanger according to the embodiments of the present disclosure, for example, the space occupied by the connecting pipe assembly in the manifold can be reduced.

DETAILED DESCRIPTION

Figure 1:
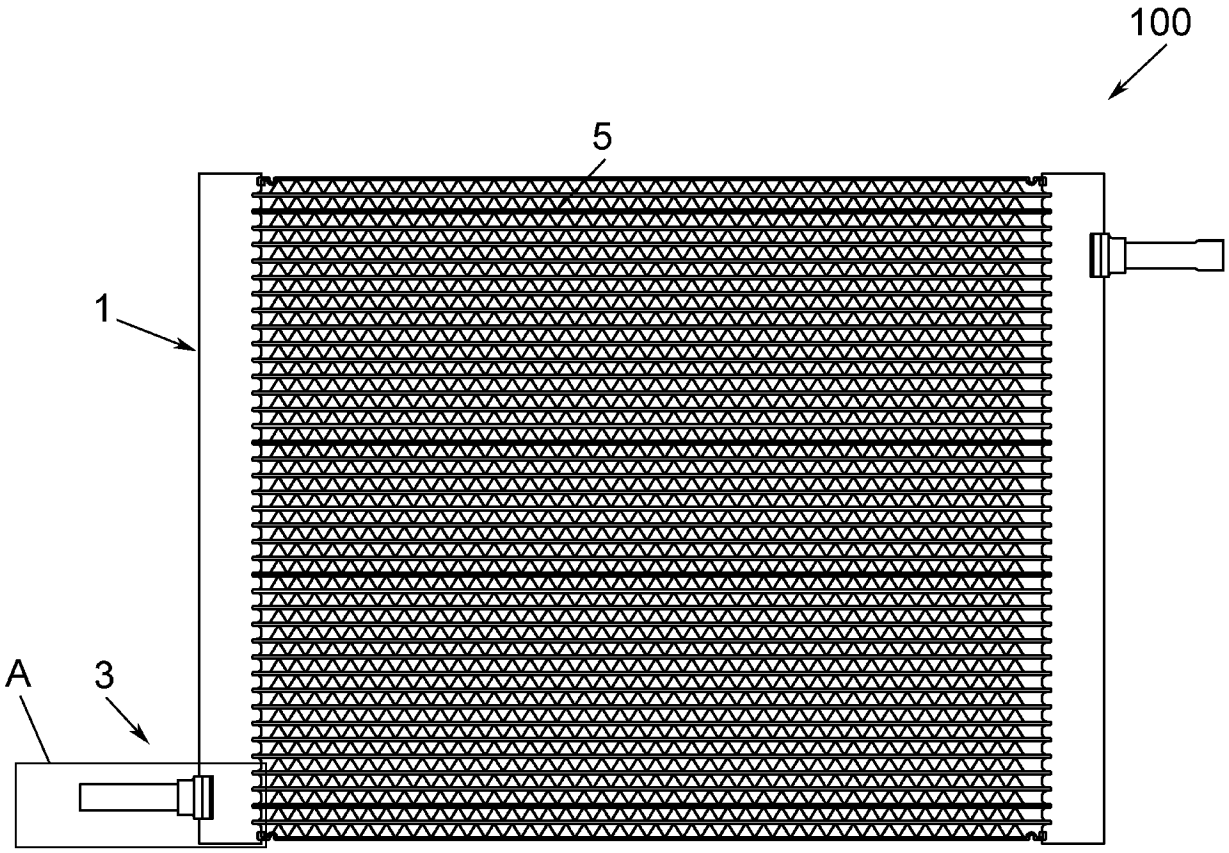
FIG. 1 is a schematic front view of a heat exchanger according to an embodiment of the present disclosure.

The present disclosure will be further described in detail below by means of embodiments in conjunction with accompanying drawings.

Referring to FIG. 1 to FIG. 5, a heat exchanger 100 according to embodiments of the present disclosure includes: a manifold 1 having a manifold opening 11 passing through a pipe wall 10 of the manifold 1; a distribution pipe 2 disposed in the manifold 1 and having a distribution pipe opening 21 passing through a pipe wall 20 of the distribution pipe 2; and a connecting pipe assembly 3 including a first connecting pipe 31. The first connecting pipe 31 is inserted in the manifold opening 11, has an end 310 connected to the distribution pipe 2 at the distribution pipe opening 21, and is in fluid communication with the distribution pipe 2. The distribution pipe 2 may have a plurality of through holes for distributing refrigerant.

Figure 2:
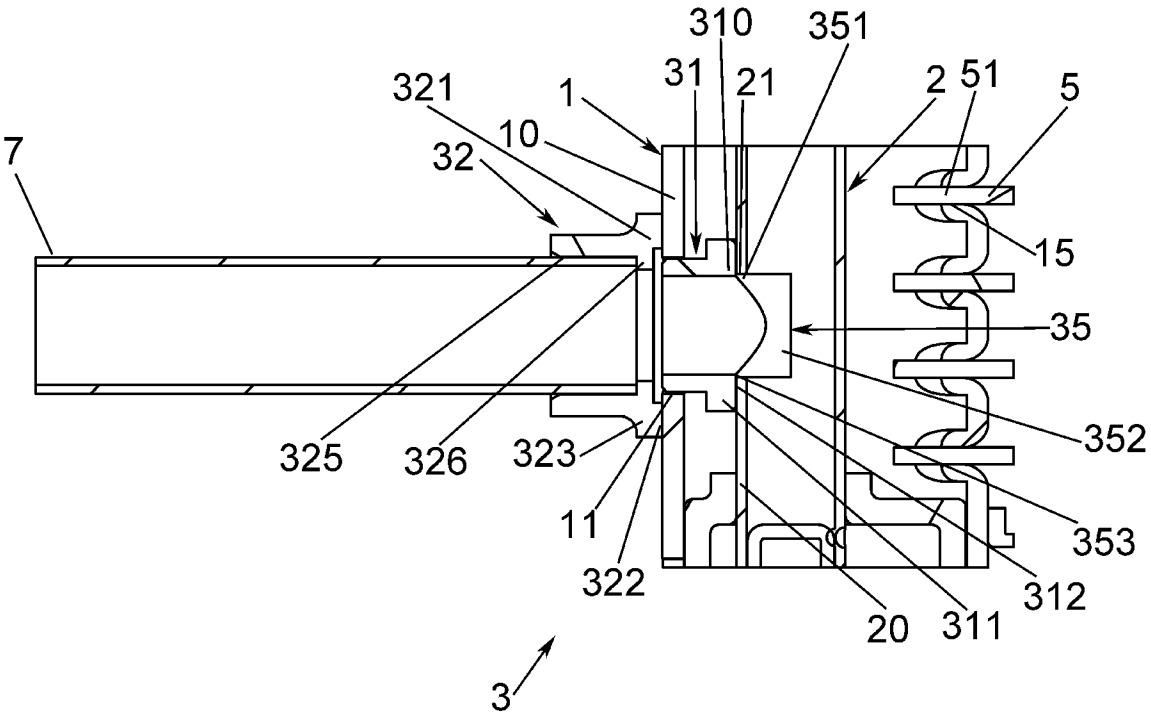
FIG. 2 is a schematic cross-sectional view of a portion A, including a connecting pipe assembly, of the heat exchanger shown in FIG. 1.
Figure 3:
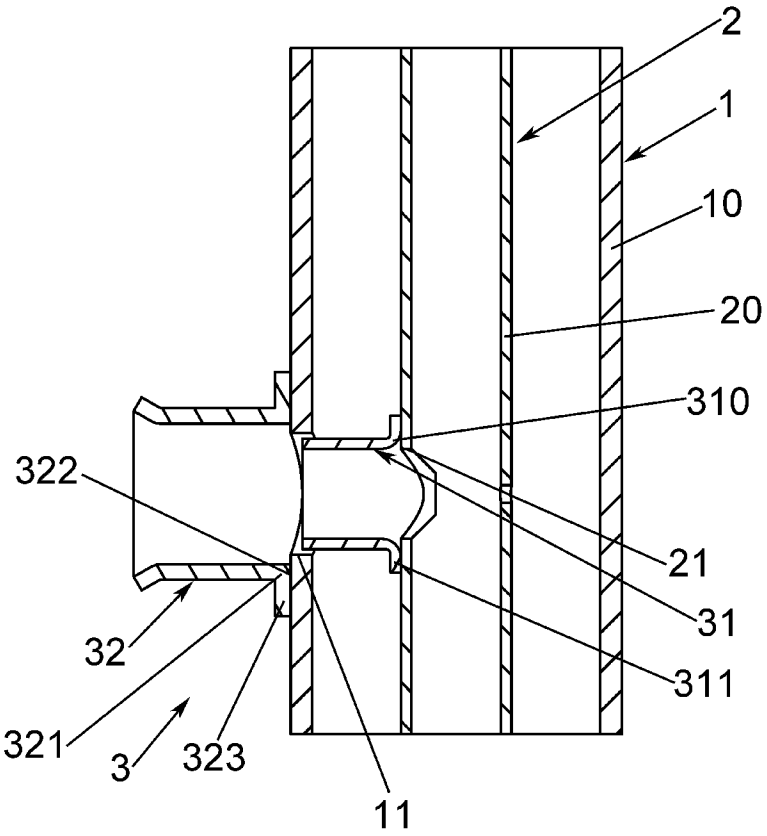
FIG. 3 is a schematic cross-sectional view of a portion, including a connecting pipe assembly, of a heat exchanger according to another embodiment of the present disclosure.

Referring to FIG. 2 and FIG. 3, in embodiments of the present disclosure, the first connecting pipe 31 includes a flange 311 extended towards a radial outside from the end 310 of the first connecting pipe 31. The flange 311 is connected to a portion of the pipe wall 20 of the distribution pipe 2 surrounding the distribution pipe opening 21. For example, a surface of the flange 311 facing the pipe wall 20 of the distribution pipe 2 has the same shape as a portion of an outer peripheral surface of the pipe wall 20 of the distribution pipe 2 surrounding the distribution pipe opening 21, for facilitating welding.

Referring to FIG. 2, in embodiments of the present disclosure, an inner diameter of the end 310 of the first connecting pipe 31 is smaller than an inner diameter of the distribution pipe opening 21. The connecting pipe assembly 3 further includes an insertion pipe 35. A first end 351 of the insertion pipe 35 close to the first connecting pipe 31 is inserted in the distribution pipe opening 21, and an end face 353 of the first end 351 of the insertion pipe 35 abuts against an end face 312 of the end 310 of the first connecting pipe 31, and a second end 352 of the insertion pipe 35 opposite to the first end 351 is located in the distribution pipe 2. For example, the end face 353 of the first end 351 of the insertion pipe 35 has the same shape as the end face 312 of the end 310 of the first connecting pipe 31.

Referring to FIG. 2 and FIG. 3, in embodiments of the present disclosure, the connecting pipe assembly 3 further includes a second connecting pipe 32. An end face 322 of an end 321 of the second connecting pipe 32 close to the manifold 1 is connected to a portion of the pipe wall 10 of the manifold 1 surrounding the manifold opening 11. For example, the end surface 322 of the end 321 of the second connecting pipe 32 close to the manifold 1 has the same shape as a portion of an outer peripheral surface of the pipe wall 10 of the manifold 1 surrounding the manifold opening 11. The second connecting pipe 32 of the connecting pipe assembly 3 may include a flange 323 extended towards a radial outside from the end 321 of the second connecting pipe 32 close to the manifold 1. A surface of the flange 323 of the second connecting pipe 32 close to the manifold 1 and the end face 322 of the end 321 have the same shape as the portion of the outer peripheral surface of the pipe wall 10 of the manifold 1 surrounding the manifold opening 11. In addition, the second connecting pipe 32 of the connecting pipe assembly 3 further includes a protrusion or annular step 326 protruding towards a radial inside from an inner wall 325 of the second connecting pipe 32 on a side of the second connecting pipe 32 close to the manifold 1. A connection pipe 7 of the heat exchanger 100 is inserted in the second connecting pipe 32, and an end of the connection pipe 7 abuts against the protrusion or annular step 326.

Referring to FIG. 3, in embodiments of the present disclosure, an inner diameter of the end 321, close to the manifold 1, of the second connecting pipe 32 of the connecting pipe assembly 3 is greater than an inner diameter of the manifold opening 11. The connection pipe 7 of the heat exchanger 100 is inserted in the second connecting pipe 32, and the end of the connection pipe 7 abuts against the pipe wall 10 of the manifold 1.

Figure 4:
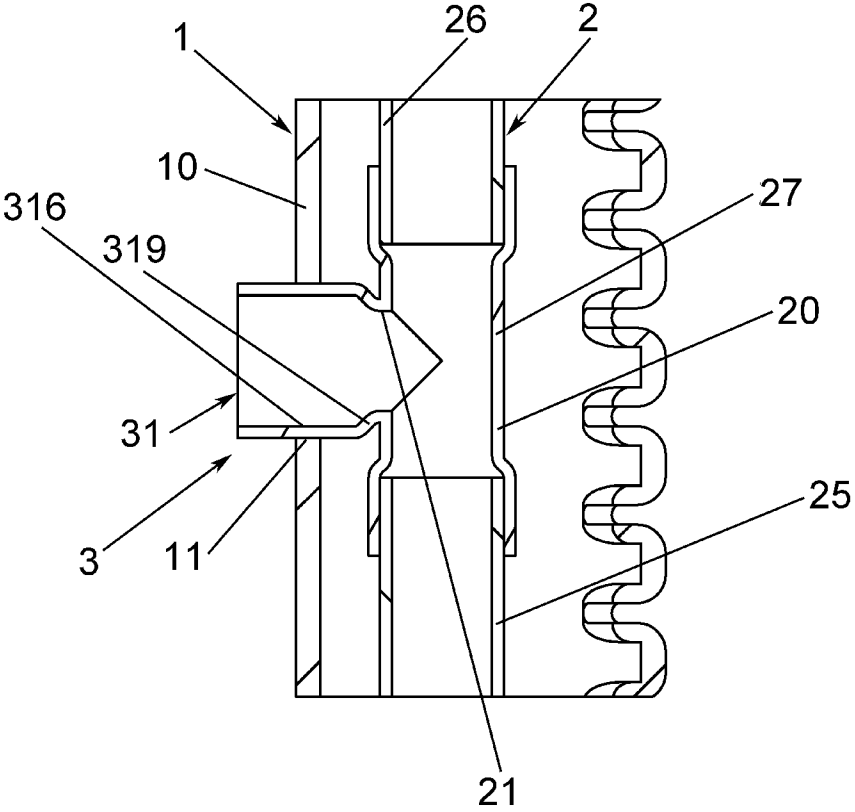
FIG. 4 is a schematic cross-sectional view of a portion, including a connecting pipe assembly, of a heat exchanger according to yet another embodiment of the present disclosure.
Figure 5:
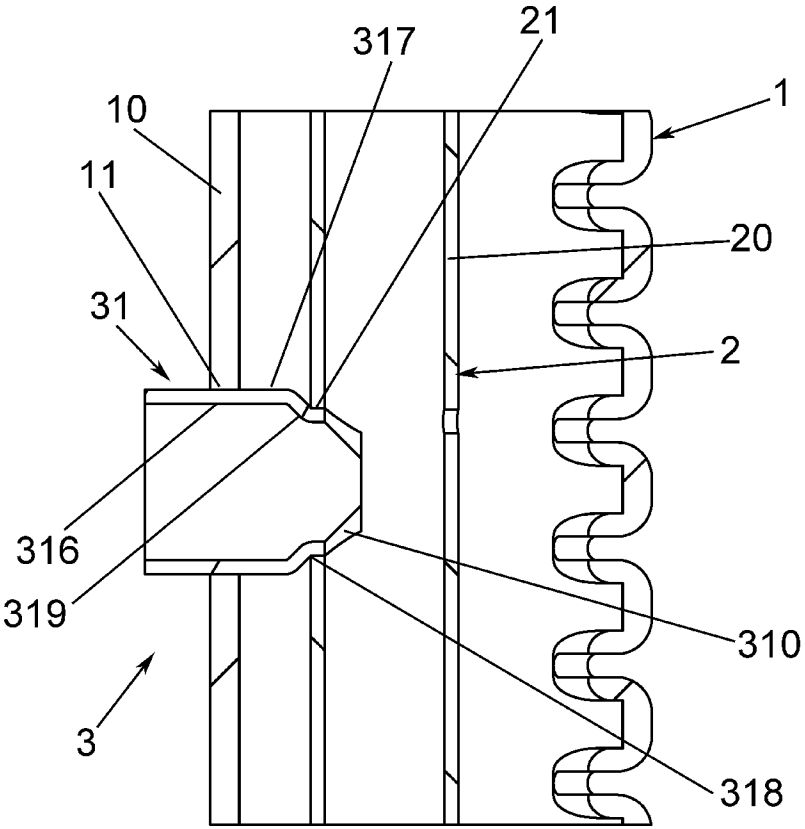
FIG. 5 is a schematic cross-sectional view of a portion, including a connecting pipe assembly, of a heat exchanger according to still another embodiment of the present disclosure.

Referring to FIG. 5, in embodiments of the present disclosure, the end 310 of the first connecting pipe 31 is inserted in the distribution pipe opening 21. For example, the end 310 of the first connecting pipe 31 may have a tapered shape, and the cross-sectional area of the end 310 of the first connecting pipe 31 decreases gradually in a direction away from the manifold opening 11. The first connecting pipe 31 may further include an annular step portion 318 located on an outer wall 317 of the first connecting pipe 31 and adjacent to the end 310 of the first connecting pipe 31, and a portion of the pipe wall 20 of the distribution pipe 2 surrounding the distribution pipe opening 21 abuts against the annular step portion 318 of the outer wall 317 of the first connecting pipe 31. Referring to FIG. 4 and FIG. 5, the first connecting pipe 31 may further include an annular step portion 319 located on an inner wall 316 of the first connecting pipe 31 and adjacent to the end 310 of the first connecting pipe 31. The connection pipe 7 of the heat exchanger 100 is inserted in the first connecting pipe 31, and the end of the connection pipe 7 abuts against the annular step portion 319 located on the inner wall 316 of the first connecting pipe 31. Referring to FIG. 4 and FIG. 5, the first connecting pipe 31 is extended to an outside of the manifold 1 through the manifold opening 11 of the pipe wall 10 of the manifold 1. The end 310 of the first connecting pipe 31 may have a conical shape.

Referring to FIG. 4, in embodiments of the present disclosure, the distribution pipe 2 includes: a first distribution pipe section 25 and a second distribution pipe section 26 spaced apart from each other in an axial direction and a distribution pipe connecting section 27 connected between the first distribution pipe section 25 and the second distribution pipe section 26. The distribution pipe opening 21 is formed in the distribution pipe connecting section 27. The distribution pipe connecting section 27 of the distribution pipe 2 and the first connecting pipe 31 of the connecting pipe assembly 3 may be an integrated three-way pipe. The first connecting pipe 31 is extended to the outside of the manifold 1 through the manifold opening 11 of the pipe wall 10 of the manifold 1.

Referring to FIG. 1 and FIG. 2, in embodiments of the present disclosure, the manifold 1 further has a heat exchange tube connecting opening 15 passing through the pipe wall 10 of the manifold 1. The heat exchanger 100 further includes heat exchange tubes 5 and fins arranged alternately with the heat exchange tubes 5. An end 51 of the heat exchange tube 5 is connected to the heat exchange tube connecting opening 15 of the manifold 1, and an angular interval between a centerline of the manifold opening 11 and a centerline of the heat exchange tube connecting opening 15 in a circumferential direction of the manifold 1 is between 60° and 180°. In the embodiment shown in FIG. 1 and FIG. 2, the heat exchange tube 5 is connected to the tube wall 10 of the manifold 1 on one side of the tube wall 10 of the manifold 1, and the manifold opening 11 is formed on the other side, opposite to the one side, of the tube wall 10 of the manifold 1, and the end 51 of the heat exchange tube 5 is inserted in the heat exchange tube connecting opening 15 of the manifold 1.

According to embodiments of the present disclosure, the connecting pipe assembly 3 is disposed at a position between a first point and a second point in an axial direction of the manifold 1. A distance from the first point to one end, in the axial direction, of the manifold 1 in the axial direction of the manifold 1 is ¼ of a total length of the manifold 1, and a distance from the second point to the one end, in the axial direction, of the manifold 1 in the axial direction of the manifold 1 is ¾ of the total length of the manifold 1. Since the connecting pipe assembly 3 is located in the middle, in a length direction, of the manifold 1, which is equivalent to dividing the distribution pipe into two parts with equal lengths or with little difference in length, the length of the distribution pipe is minimized so that the refrigerant is distributed more uniformly. The refrigerant enters the distribution pipe 2 from the connecting pipe assembly 3, flows from the middle to both ends in the distribution pipe 2, then flows into the manifold 1, and then flows into the heat exchange tube 5, thereby optimizing the distribution of the refrigerant.

With the heat exchanger according to the embodiments of the present disclosure, for example, the space occupied by the connecting pipe assembly in the manifold can be reduced.

In addition, since the connecting pipe assembly is connected to the pipe wall of the manifold, the size of the heat exchanger in the axial direction of the manifold can be reduced. At the same time, since the connecting pipe assembly has small mass and volume, it will not cause local heat absorption to affect the soldering quality during the soldering process of the heat exchanger. In addition, the connecting pipe assembly occupies very little space in the manifold, and thus the flow of refrigerant in the manifold will not be affected.

Although the above embodiments have been described, some features of the above embodiments can be combined to form new embodiments.

For example, although in the embodiments shown in FIG. 4 and FIG. 5, only the first connecting pipe 31 is disposed without the second connecting pipe 32, in the embodiments shown in FIG. 4 and FIG. 5, it is also possible to provide the second connecting pipe 32 shown in FIG. 2 and FIG. 3. In this case, the first connecting pipes 31 shown in FIG. 4 and FIG. 5 may not be extended to the outside of the manifold 1 through the manifold opening 11 of the pipe wall 10 of the manifold 1.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger, comprising:

a manifold having a manifold opening passing through a pipe wall of the manifold;

a distribution pipe disposed in the manifold and having a distribution pipe opening passing through a pipe wall of the distribution pipe;

a connecting pipe assembly comprising a first connecting pipe, wherein the first connecting pipe is inserted in the manifold opening, has an end connected to the distribution pipe at the distribution pipe opening, and is in fluid communication with the distribution pipe;

wherein the first connecting pipe comprises a flange extended towards a radial outside from the end of the first connecting pipe, wherein the flange is connected to a portion of the pipe wall of the distribution pipe surrounding the distribution pipe opening, wherein an inner diameter of the end of the first connecting pipe is smaller than an inner diameter of the distribution pipe opening; and the connecting pipe assembly further comprises an insertion pipe, wherein a first end of the insertion pipe close to the first connecting pipe is inserted in the distribution pipe opening, and an end face of the first end of the insertion pipe abuts against an end face of the end of the first connecting pipe, and a second end of the insertion pipe opposite to the first end is located in the distribution pipe.

2. The heat exchanger according to claim 1, wherein the connecting pipe assembly further comprises a second connecting pipe, and an end face of an end of the second connecting pipe close to the manifold is connected to a portion of the pipe wall of the manifold surrounding the manifold opening.

3. The heat exchanger according to claim 2, wherein the second connecting pipe of the connecting pipe assembly comprises a flange extended towards a radial outside from the end of the second connecting pipe close to the manifold.

4. The heat exchanger according to claim 3, wherein the second connecting pipe of the connecting pipe assembly further comprises a protrusion or annular step protruding towards a radial inside from an inner wall of the second connecting pipe on a side of the second connecting pipe close to the manifold.

5. The heat exchanger according to claim 3, wherein an inner diameter of the end, close to the manifold, of the second connecting pipe of the connecting pipe assembly is greater than an inner diameter of the manifold opening.

6. The heat exchanger according to claim 1, wherein the end of the first connecting pipe is inserted in the distribution pipe opening.

7. The heat exchanger according to claim 6, wherein the first connecting pipe further comprises an annular step portion located on an outer wall of the first connecting pipe and adjacent to the end of the first connecting pipe, and a portion of the pipe wall of the distribution pipe surrounding the distribution pipe opening abuts against the annular step portion of the outer wall of the first connecting pipe.

8. The heat exchanger according to claim 7, wherein the first connecting pipe further comprises an annular step portion located on an inner wall of the first connecting pipe and adjacent to the end of the first connecting pipe.

9. The heat exchanger according to claim 6, wherein the connecting pipe assembly further comprises a second connecting pipe, and an end face of an end of the second connecting pipe close to the manifold is connected to a portion of the pipe wall of the manifold surrounding the manifold opening.

10. The heat exchanger according to claim 6, wherein the first connecting pipe is extended to an outside of the manifold through the manifold opening of the pipe wall of the manifold.

11. The heat exchanger according to claim 1, wherein the manifold further has a heat exchange tube connecting opening passing through the pipe wall of the manifold, the heat exchanger further comprises a heat exchange tube having an end connected to the heat exchange tube connecting opening of the manifold, and an angular interval between a centerline of the manifold opening and a centerline of the heat exchange tube connecting opening in a circumferential direction of the manifold is between 60° and 180°.

12. The heat exchanger according to claim 1, wherein the first connecting pipe is extended to an outside of the manifold through the manifold opening of the pipe wall of the manifold.

13. The heat exchanger according to claim 1, wherein the connecting pipe assembly is disposed, along an axial direction of the manifold, between ¼ of a total length of the manifold from one end and ¾ of the total length of the manifold from the one end.

14. The heat exchanger according to claim 1, wherein the first connecting pipe is extended to an outside of the manifold through the manifold opening of the pipe wall of the manifold.

15. The heat exchanger according to claim 14, wherein the connecting pipe assembly further comprises a second connecting pipe, and an end face of an end of the second connecting pipe close to the manifold is connected to a portion of the pipe wall of the manifold surrounding the manifold opening.

16. A heat exchanger, comprising:

a manifold having a manifold opening passing through a pipe wall of the manifold;

a distribution pipe disposed in the manifold and having a distribution pipe opening; and a connecting pipe assembly comprising a first connecting pipe, wherein the first connecting pipe is inserted in the manifold opening, has an end connected to the distribution pipe at the distribution pipe opening, and is in fluid communication with the distribution pipe, wherein the distribution pipe comprises:

a first distribution pipe section and a second distribution pipe section spaced apart from each other in an axial direction and a distribution pipe connecting section connected between the first distribution pipe section and the second distribution pipe section, and the distribution pipe opening passing through a pipe wall of the distribution pipe connecting section.

17. The heat exchanger according to claim 16, wherein the distribution pipe connecting section of the distribution pipe and the first connecting pipe of the connecting pipe assembly are an integrated three-way pipe.

18. The heat exchanger according to claim 17, wherein the connecting pipe assembly further comprises a second connecting pipe, and an end face of an end of the second connecting pipe close to the manifold is connected to a portion of the pipe wall of the manifold surrounding the manifold opening.

19. The heat exchanger according to claim 16, wherein the connecting pipe assembly further comprises a second connecting pipe, and an end face of an end of the second connecting pipe close to the manifold is connected to a portion of the pipe wall of the manifold surrounding the manifold opening.

* * * * *